US007034235B2

(12) United States Patent
Hosaka

(10) Patent No.: US 7,034,235 B2
(45) Date of Patent: Apr. 25, 2006

(54) KEY SHEET

(75) Inventor: Junko Hosaka, Tokyo (JP)

(73) Assignee: Polymatech Co., Ltd., (JP)

( * ) Notice: Subject to any disclaimer, the term of this patent is extended or adjusted under 35 U.S.C. 154(b) by 0 days.

(21) Appl. No.: 11/009,137

(22) Filed: Dec. 13, 2004

(65) Prior Publication Data

US 2005/0139460 A1 Jun. 30, 2005

(30) Foreign Application Priority Data

Dec. 25, 2003 (JP) ..... 2003-431441

(51) Int. Cl.
*H01H 9/00* (2006.01)

(52) U.S. Cl. ..... 200/314; 200/341

(58) Field of Classification Search ..... 200/5 A, 200/5 R, 310–314, 512–517, 341–345; 345/168, 345/268; 400/472
See application file for complete search history.

(56) References Cited

U.S. PATENT DOCUMENTS 5,225,818 A 7/1993 Lee et al.
5,557,079 A * 9/1996 Jackson et al. ..... 200/5 A
5,661,279 A * 8/1997 Kenmochi ..... 200/314
6,180,895 B1 * 1/2001 Hutchinson et al. ..... 200/5 A
6,259,044 B1 * 7/2001 Paratore et al. ..... 200/5 A
6,835,906 B1 * 12/2004 Okamoto et al. ..... 200/341
6,928,297 B1 * 8/2005 Kitamura et al. ..... 455/550.1
2003/0173198 A1 * 9/2003 Hanahara et al. ..... 200/314
2004/0200712 A1 * 10/2004 Nishimura et al. ..... 200/512
2005/0000788 A1 * 1/2005 Nishimura ..... 200/512
2005/0167254 A1 * 8/2005 Oosawa ..... 200/314

OTHER PUBLICATIONS

Europian Seach Report for co-pending application mailed on Mar. 31, 2005.

* cited by examiner

*Primary Examiner*—Michael Friedhofer
*Assistant Examiner*—Lisa Klaus
(74) *Attorney, Agent, or Firm*—Rader, Fishman, & Grauer PLLC

(57) ABSTRACT

A key sheet includes a base sheet and a plurality of key tops arranged on the base sheet. The base sheet includes an elastic member formed of a rubber-like elastic body and a light-reflective reinforcing member. The light-reflective reinforcing member having at least one surface constitutes the metal-containing face.

17 Claims, 15 Drawing Sheets

KEY SHEET

BACKGROUND OF THE INVENTION

1. Field of the Invention

The present invention relates to a key sheet for a push-button switch for use in an operating portion of various apparatuses such as a mobile phone, a PDA, a car navigation apparatus, and a car audio apparatus. In particular, the present invention relates to a key sheet suitable for an application in which a plurality of key tops are exposed for use through an operation opening which is formed in the casing of an apparatus without a partition frame.

2. Description of the Related Art

Like a mobile phone 1 shown in FIG. 13, due to requirements in terms of miniaturization of the entire device or an operating portion thereof, artistic design properties, and the like, it has been desired to provide a pushbutton switch in which plural key tops 3 of a key sheet 2 (FIG. 14) arranged at a narrow spacing are exposed through an operation opening 1*b* which is formed in a casing 1*a* without a partition frame. As shown in FIG. 14, the key sheet 2 of the background art is constructed of a plurality of (seventeen in total) key tops 3 firmly attached to abase sheet 4 made of silicone rubber. Specifically, the key sheet 2 includes a large key top 3*a* situated in the upper middle section thereof and used for directional input in the vertical and horizontal directions, four small key tops 3*b* situated on the right-hand and left-hand sides of the key top 3*a*, and twelve medium-sized key tops 3*c* situated below the key tops 3*b*. The gaps between the adjacent key tops 3*a*, 3*b*, and 3*c* are extremely narrow, the key tops being arranged at a spacing, for example, as small as approximately 0.15 mm to 0.2 mm. The gap between the key tops and the operation opening 1*b* is also very narrow, its dimension being approximately the same as mentioned above. An art relating to such a key sheet 2 with a narrow key top spacing is disclosed in, for example, Japanese Patent Application No. 2003-114833.

As shown in FIG. 15, in mounting the key sheet 2, the outer edge portion of the base sheet 4 is held in press contact with structural elements inside the casing 1*a* over the entire circumference thereof. In the case of this background art, those structural elements are the opening edge portion of the operation opening 1*b* on a back surface 1*c* of the casing 1*a*, and a circuit board 1*d* built in the casing 1*a*. According to this mounting structure, on the inner side of the press-contact portion, the key sheet 2 is not locked with respect to the casing 1*a* and the circuit board 1*d*. Accordingly, when the key sheet 2 is set upright or is laid face down during use of the mobile phone 1, the base sheet 4, which includes a rubber-like elastic body such as flexible silicone rubber, may expand in its entirety under the weight of the key tops 3 to be there by distorted. This may lead to positional deviation between pushers 4*a* of the base sheet 4 and contact switches 1*e* that are provided on the circuit board 1*d* and composed of metal disc springs and a contact circuit, resulting in operation failures such as the inability or difficulty of effecting input even when the key tops 3 are depressed. Further, depending on the manner of distortion of the base sheet 4, the depression stroke for input may differ among the key tops 3, which may adversely affect the operability. This may also impair the appearance of the mobile phone 1. Moreover, one of adjacent key tops 3 may slip into the space under the other.

The above-mentioned problems, which arise due to the distortion of the base sheet 4 fabricated of a flexible rubber-like elastic body, can occur whenever two or more key tops are arranged per one operation opening. Further, the slippage of one key top under the other can occur not only in the case of a portable apparatus such as the mobile phone 1 but also in the case of a stationary apparatus. Therefore, a solution to these problems has been demanded.

SUMMARY OF THE INVENTION

The present invention has been made in view of the prior art described above. It is therefore an object of the present invention to minimize the distortion of a key sheet having a plurality of key tops arranged at a narrow spacing.

In order to attain the above-mentioned object, according to the present invention, there is provided a key sheet including a base sheet, and a plurality of key tops arranged on the base sheet and exposed through an operation opening which is formed in a casing of an apparatus without partition frames, in which the base sheet is composed of an elastic member formed of a rubber-like elastic body and having a plurality of floating portions to which the key tops are firmly attached, and a light-reflective reinforcing member that supports the floating portions while permitting depression displacement of the floating portions, and in which at least one surface of the light-reflective reinforcing member is a metal-containing face.

In one specific aspect of the invention, the light-reflective reinforcing member is formed of a laminate of a reinforcing member made of hard resin and a metal layer provided on a surface of the reinforcing member.

According to the key sheet of the present invention, the base sheet includes the elastic member formed of a rubber-like elastic body and having the plurality of floating portions to which the key tops are firmly attached, and the light-reflective reinforcing member that supports the floating portions while permitting depression displacement of the floating portions, and the rigidity of the base sheet is enhanced by means of the reinforcing member, whereby there is virtually no fear of distortion of the base sheet. Therefore, various problems arising from distortion of the base sheet can be substantially or completely eliminated, including operational failures due to positional deviation between the key tops and contact switches, a deterioration in operability due to a difference in depression stroke among the key tops, a deterioration in the artistic design properties of the apparatus, and slipping of the key tops one under the other. Further, the light-reflective reinforcing member is formed as the laminate of the elastic member made of hard resin and the metal layer, and at least one surface of the light-reflective reinforcing member is formed as the metal-containing face. This construction makes the key sheet resistant to the generation of static electricity, making it possible to prevent erroneous input or contamination resulting from such generation of static electricity. It should be noted that providing a grounded portion enables more efficient removal of static electricity.

The thickness of the metal film may be set within a range of 10 nm to 80 nm. The metal layer with a thickness of 10 nm to 80 nm is very thin, which makes it possible to prevent the generation of static electricity without changing the sizes and configurations of the reinforcing member and the elastic member.

In another specific aspect of the invention, the light-reflective reinforcing member is a reinforcing member made of metal.

According to the key sheet of the present invention, the base sheet is composed of the elastic member formed of a rubber-like elastic body and having the plurality of floating portions to which the key tops are firmly attached, and the reinforcing member made of metal that supports the floating portions while permitting depression displacement of the floating portions, whereby the base sheet obtained is substantially or completely free from distortion. Therefore, it is possible to substantially or completely eliminate various problems arising from distortion of the base sheet, such as operational failures due to positional deviation between the key tops and contact switches, a deterioration in operability due to a difference in depression stroke among the key tops, a deterioration in the artistic design properties of the apparatus, and slipping of the key tops one under the other. Further, the light-reflective reinforcing member is formed of a reinforcing member made of metal, and at least one surface of the light-reflective reinforcing member is formed as the metal-containing face. This construction makes the key sheet resistant to the generation of static electricity, making it possible to prevent erroneous input or contamination resulting from such generation of static electricity.

The thickness of the reinforcing member made of metal may be set within a range of 50 μm to 2,000 μm. With the thickness of the reinforcing member made of metal thus being within the range of 50 μm to 2,000 μm, it is possible to impart rigidity to the base sheet as a whole, making the base sheet substantially or completely free from distortion. Further, it is possible to suppress generation of static electricity in the key sheet.

As described above, the key sheet of the present invention can overcome problems resulting from distortion of the base sheet. Therefore, the key sheet can be adapted to meet the demand of miniaturization of the overall apparatus construction or the operating portion without relying on a method which would adversely affect the operability, namely reducing the size of the key top itself.

The above-described key sheet can be implemented as an illumination type key sheet whose key tops are illuminated by light emitted from an illumination light source (hereinafter also referred to as "internal light source") arranged on a back surface of the base sheet. When the key sheet is thus implemented as an illumination type key sheet, its key tops are clearly visible even at night or in dark places as they are illuminated by light from the illumination light source provided inside the apparatus, and the obtained key sheet is also superior in artistic design properties. Further, the light emitted from the illumination light source is reflected by the metal layer or the reinforcing member made of metal, whereby the light can be efficiently guided within the base sheet, thus reducing unevenness in illumination. Further, light can be illuminated uniformly through a desired location.

Further, in the present invention, the above-described illumination type key sheet has a cutaway portion, which allows entry of the illumination light source, formed in the elastic member at each of intersection positions between vertical frames and horizontal frames of the grid-like reinforcing member.

When the light-reflective reinforcing member is provided to one face of the elastic member which is situated on the key top side, light that is emitted vertically upward from the internal light source arranged in the cutaway portion is readily reflected by the metal-containing face and efficiently guided within the base sheet to reach the key tops. This construction overcomes the problem in which only the key tops in the vicinity of the light source are brightly illuminated, thus providing uniform illumination over the key tops.

Further, when the light-reflective reinforcing member is provided to one face of the elastic member situated on the side opposite to key tops, the cutaway portion penetrates through the light-reflective reinforcing member, whereby light emitted from the internal light source arranged in the cutaway portion can be efficiently guided in the interior of the elastic member. As a result, a brightly-lit key sheet, which permits illumination of light through the entire key sheet, can be obtained.

When the light-reflective reinforcing member is provided to an upper face of a thick-walled portion formed in the elastic member, it is possible to prevent leakage of light from the upper face of the thick-walled portion to the key top-side surface. Further, when the light-reflective reinforcing member is provided to a bottom face of the thick-walled portion formed in the elastic member, the light that is otherwise absorbed by the bottom face of the thick-walled portion can be reflected by the bottom face, thereby facilitating the guidance of light from the internal light source.

It should be recognized that the above description does not limit the scope of the present invention, and the purposes, advantages, features, and uses of the present invention will be clarified by the following description with reference to the attached drawings. Moreover, it should be understood that all modifications made as appropriate without departing from the spirit of the present invention fall within the scope of the present invention.

DESCRIPTION OF THE PREFERRED EMBODIMENTS

Figure 1:
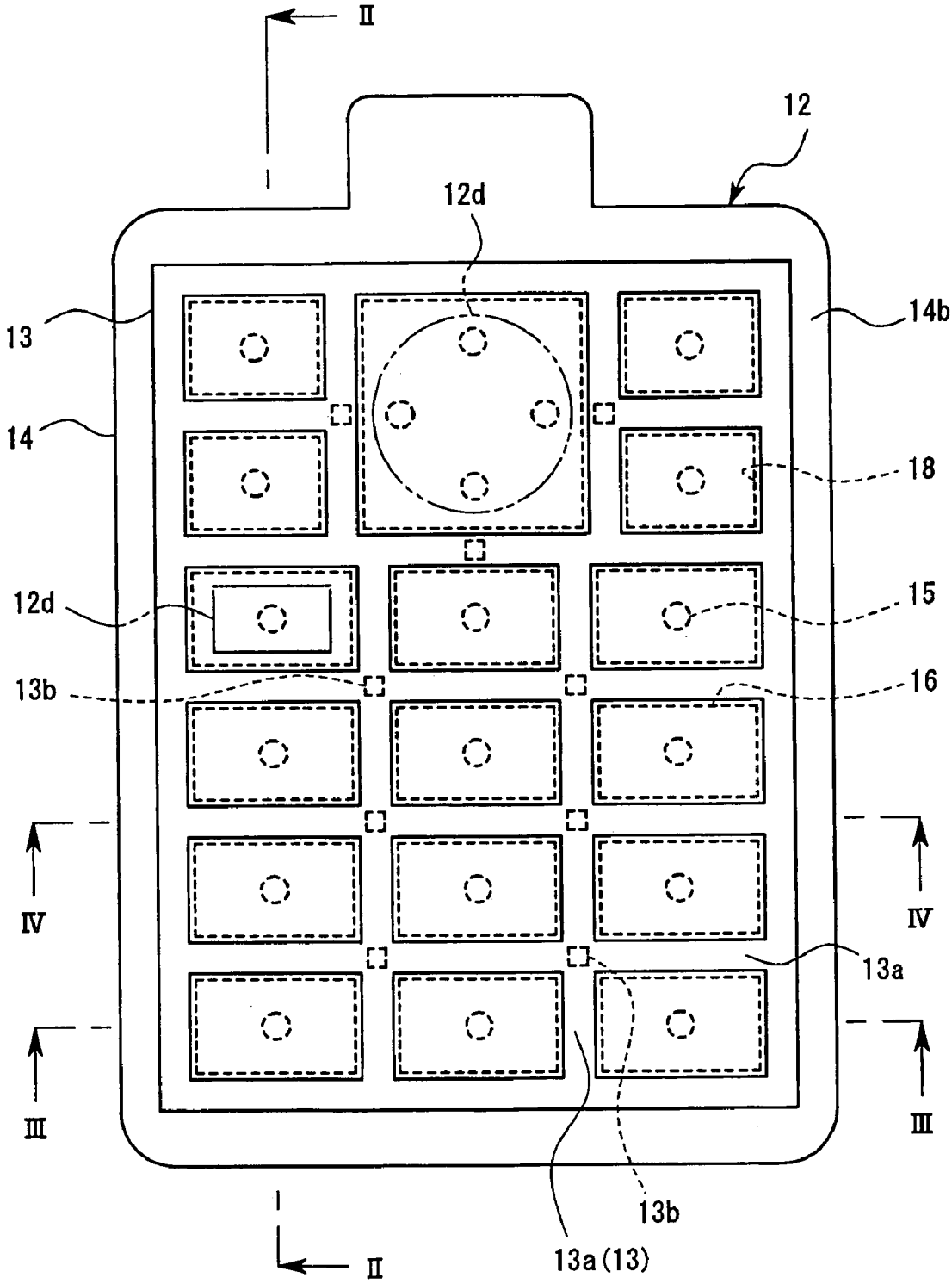
FIG. 1 is an outward view of an upper surface of a base sheet of a key sheet according to a first embodiment of the present invention.

Hereinafter, embodiments of the present invention will be described with reference to the attached drawings. The structural components common to those of the prior art and the structural components common to respective embodiments of the present invention will be represented by the same symbols and repeated description thereof will be omitted. In the following description, a mobile phone 1 is adopted as an example of the various apparatuses to which the present invention is applicable, and a key sheet for a pushbutton switch applicable thereto will be described.

FIRST EMBODIMENT

FIGS. 1 through 4 show a key sheet 11 according to a first embodiment of the present invention. The key sheet 11 has key tops 3 firmly attached to a base sheet 12. The base sheet 12 is formed by integrating a light-reflective reinforcing member 10, which is fabricated of a resin film 13 made of hard resin and a metal layer 19, with an elastic member 14 fabricated of a rubber-like elastic body.

Figure 2:
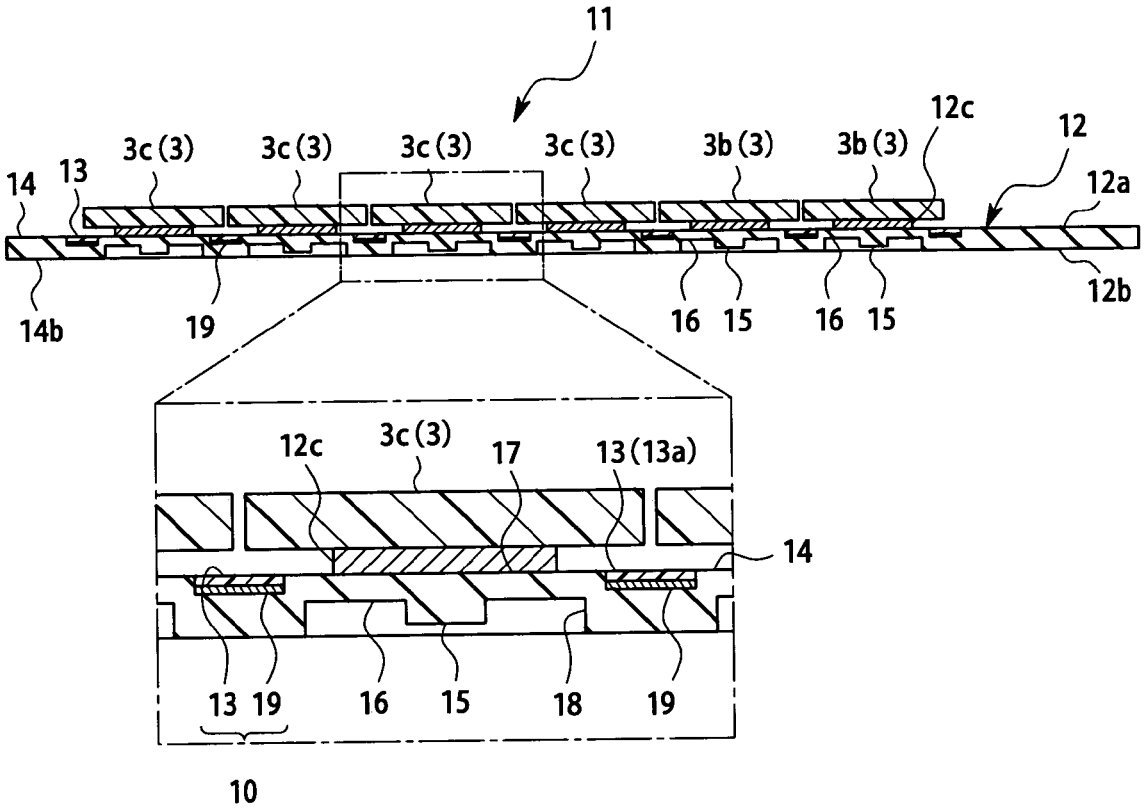
FIG. 2 is a sectional view of the key sheet taken along the line II—II of FIG. 1.
Figure 3:
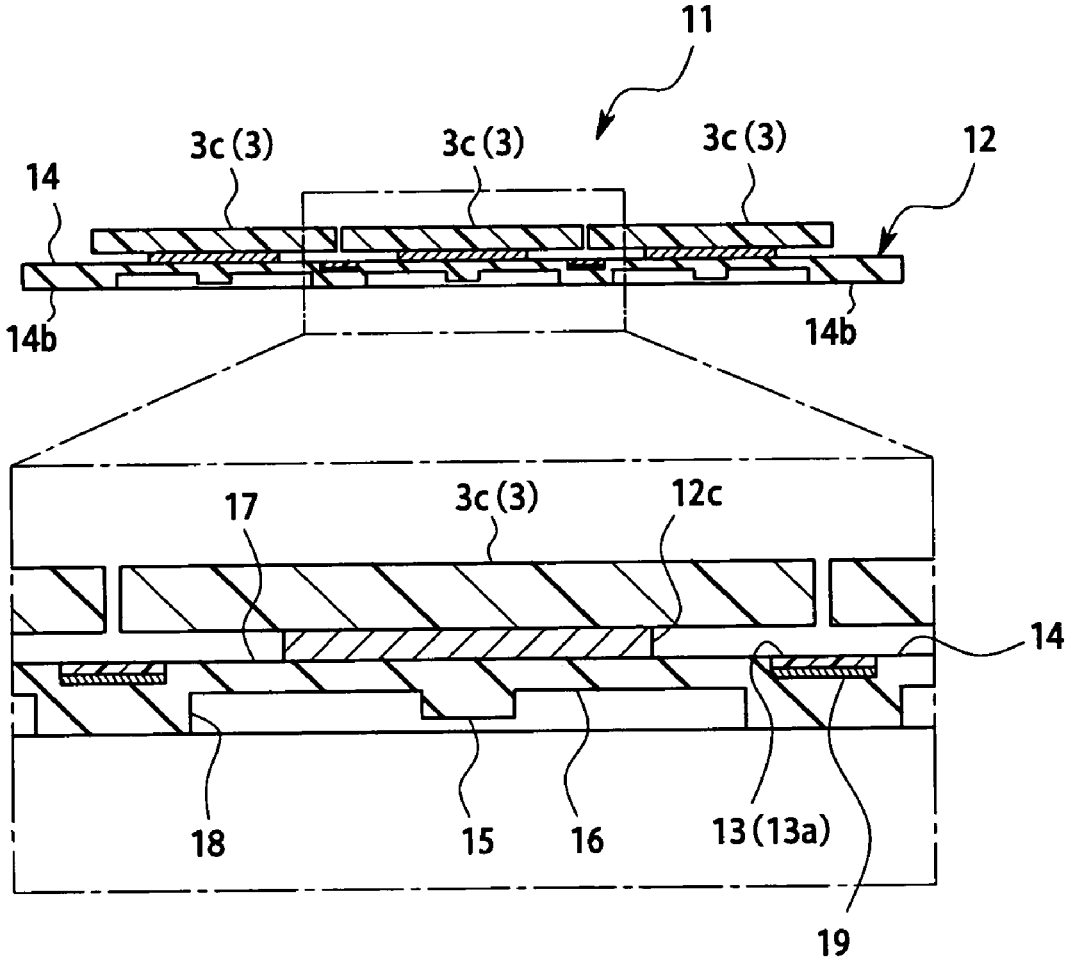
FIG. 3 is a sectional view of the key sheet taken along the line III—III of FIG. 1.
Figure 4:
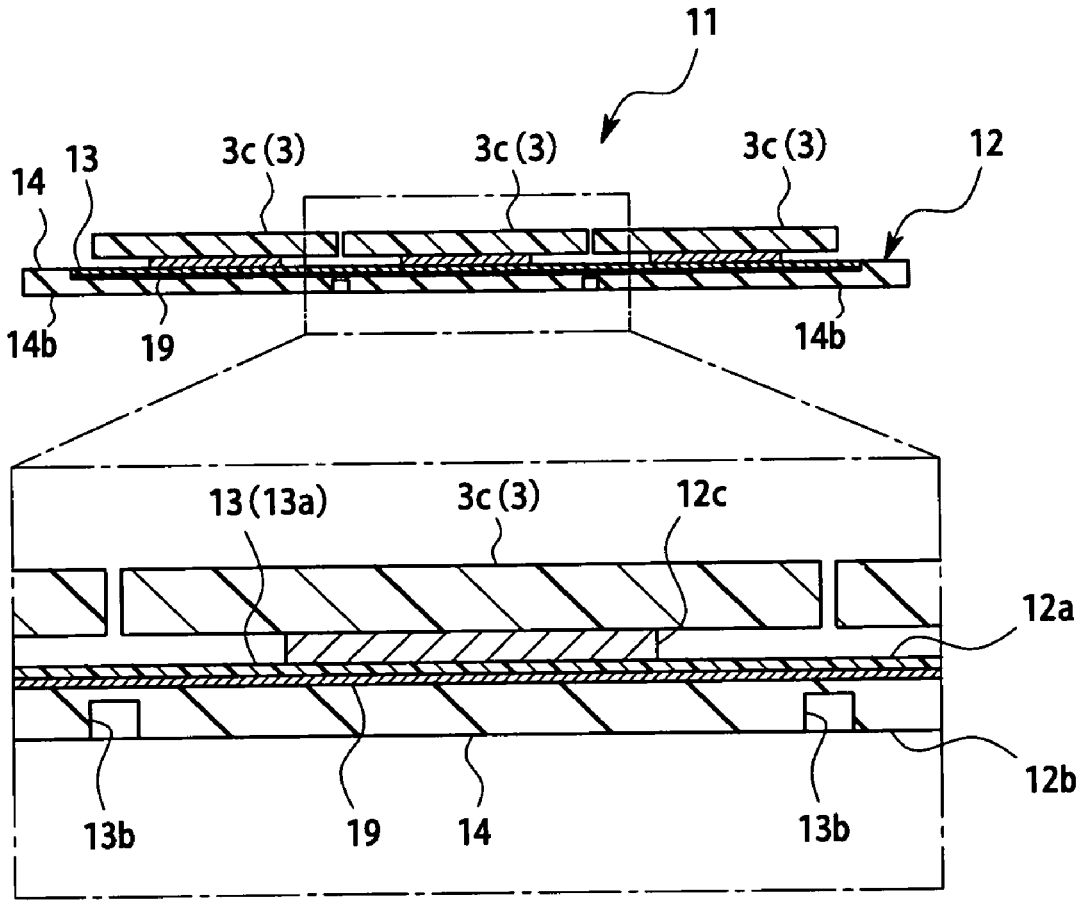
FIG. 4 is a sectional view of the key sheet taken along the line IV—IV of FIG. 1.

FIG. 1 is a plan view showing the base sheet 12 of the key sheet 11, illustrating the base sheet 12 with no key tops 3 attached as seen from a direction in which the key tops 3 are attached thereto. Referring to the figure, the base sheet 12 has a rectangular shape in an outward appearance with rounded corners and a rectangular tongue portion formed at the top. As shown in FIGS. 2 through 4, the base sheet 12 has a flat, even upper surface 12*a*, making it possible to achieve a reduction in weight and a low-profile construction, the latter being achieved by a reduced thickness at the attaching portion of the key tops 3. Formed on a bottom surface 12*b* of the base sheet 12 is a plurality of recesses 16 each defining a protruding pusher 15. The rubber-like elastic body is thin at the portion of the recesses 16, and this thin-walled portion serves as a floating portion 17 that enables the depression displacement of the key tops 3.

Formed on the outside of the recess 16 and the floating portion 17 is a thick-walled portion 18 surrounding them. The thick-walled portion 18 is thicker than the floating portion 17 and supports the pusher 15 and the floating portion 17. The reinforcing member 13 fabricated of a resin film is firmly attached to an upper portion of the thick-walled portion 18 through the intermediation of the metal layer 19. The thick-walled portion 18 holds the reinforcing member 13 while surrounding it from three sides, that is, from the lateral side surfaces and the bottom surface such that the reinforcing member 13 is embedded in the thick-walled portion 18. The contact area between the reinforcing member 13 and the elastic member 14 is thus large, ensuring firm fixing of the two members.

As shown in FIGS. 1 and 4, in order to provide the key sheet 11 of an illumination type, a cutaway portion 13*b* allowing entry of an internal light source is formed in the elastic member 14 at each of the locations where frame portions 13*a* of the reinforcing member 13 cross each other, that is, at the intersection positions between the vertical frames and the horizontal frames of the grid-like reinforcing member 13. In this embodiment, the metal layer 19 is provided on the back surface of the reinforcing member 13 fabricated of a hard resin film arranged on the upper surface 12*a* of the base sheet 12, with the metal layer 19 being situated above the cutaway portion 13*b*. Accordingly, the light emitted vertically upward from the internal light source placed in the cutaway portion 13*b* is readily reflected by the metal layer 19 and efficiently guided within the base sheet 12 to reach each key top 3. This enables uniform illumination of the key tops 3, without involving the problem in which only the key tops 3 in the vicinity of the light source are brightly illuminated. In addition, static electricity is removed from the key sheet 11 due to the metal layer 19, thus preventing erroneous input or contamination resulting from such generation of static electricity.

Here, the material of each component constituting the base sheet 12 is described. First, in order to restrain distortion of the key sheet 11, used as the material of the reinforcing member 13 fabricated of a hard resin film is a high-rigidity material which would at least ensure that substantially no deformation occurs when holding an end of the reinforcing member 13. Examples of the material which may be used include polycarbonate resins, polymethyl methacrylate resins, polypropylene resins, polystyrene resins, polyacrylic copolymer resins, polyolefin resins, acrylonitrile butadiene styrene resins, polyester resins, epoxy resins, polyurethane resins, polyimide resins; polyamide resins such as polyamideimide resins, silicone resins; amino resins such as melamine resins, allyl resins, furan resins, phenol resins, fluorine resins, polyarylate resins, polyaryl sulfone resins, polyether sulfone resins, polyphenylene ether resins, polyphenylene sulfide resins, and polysulfone resins. While the thickness of the reinforcing member 13 is determined according to the specifications of an electronic apparatus or the like to which the reinforcing member 13 is mounted, it is generally set within a range on the order of 0.1 mm to 1.0 mm.

Examples of the rubber-like elastic body constituting the elastic member 14 include: thermosetting elastomers which have good rebound resilience and flexibility, such as silicone rubber, isoprene rubber, ethylene propylene rubber, butadiene rubber, chloroprene rubber, and natural rubber. Further, thermoplastic elastomers such as a styrene thermoplastic elastomer, ester thermoplastic elastomer, urethane thermoplastic elastomer, olefin thermoplastic elastomer, amide thermoplastic elastomer, butadiene thermoplastic elastomer, ethylene-vinyl acetate thermoplastic elastomer, fluorine rubber thermoplastic elastomer, isoprene thermoplastic elastomer, and chlorinated polyethylene elastomer may also be used. Of those, silicone rubber, styrene thermoplastic elastomer, and ester thermoplastic elastomer are preferred for their high durability in addition to superior rebound resilience.

In addition to being formed solely of metal, the metal layer 19 may include a layer produced from ink or paint mainly containing metal; the material used is preferably one which can be produced into a thin film for firm fixing to the reinforcing member 13. The metal film 19 can be formed through vapor deposition of metal such as aluminum, chrome, gold, silver, copper, nickel, and tin, or by preparing a film by using ink or paint containing fine particles of such metal. Of those, use of aluminum, chrome, silver, or the like is preferred because it allows a thin film to be formed on the surface of the reinforcing member 13 relatively easily by vapor deposition or coating.

The thickness of the metal layer is preferably from 10 nm to 80 nm. When its thickness is less than 10 nm, the metal layer exhibits visible light transmittance of 50% or higher, making it difficult to efficiently reflect light emitted from the light source. On the other hand, a thickness exceeding 80 nm brings little further improvement in the light reflection efficiency but only results in wastage of the material because a greater amount of the material becomes necessary due to the increased thickness.

To manufacture the base sheet 12 as described above, first, the reinforcing member 13 fabricated of a resin film is manufactured through die molding such as injection molding, and the light-reflective reinforcing member 10 with the metal layer 19 provided on its surface is obtained by forming the metal layer 19 in the portion of the reinforcing member 13 which comes into contact with the elastic member 14, or by previously forming the metal layer 19 in the resin film from which the reinforcing member 13 is prepared, followed by trimming. Subsequently, in the case where a thermosetting elastomer is selected, the reinforcing member 13 having the metal layer 19 is transferred into the cavity of a molding die used for molding the thermosetting elastomer, and in the case where a thermoplastic elastomer is selected, the reinforcing member 13 having the metal layer 19 is transferred into the cavity of a molding die used for molding the thermoplastic elastomer. Thereafter, a rubber-like elastic body that forms the elastic member 14 is poured into the mold for die molding. In this way, the elastic member 14 is molded integrally with the reinforcing member 13 through the intermediation of the metal layer 19, thus providing the base sheet 12.

Further, in another method of manufacturing the base sheet 22, through die molding of a rubber-like elastic body, the portion of the thick-walled portion 18 shown in FIG. 2 where the reinforcing member 13 is to be embedded is formed as a mounting groove for the reinforcing member 13 in the form of an upwardly opening recess. Then, after releasing the resulting molding from the molding die, the reinforcing member 13 to which the metal layer 19 is provided in advance is attached thereto with an adhesive, thus providing the base sheet 12 having the reinforcing member 13 attached thereto in an embedded manner. Since this manufacturing method does not involve use of the reinforcing member 13 during the die molding process of the rubber-like elastic body, it is possible to form the reinforcing member 13 by using a material which is not suited for die molding for its poor heat resistance and its susceptibility to thermal deformation but is superior in terms of other requisite characteristics of the key sheet 11 such as rigidity, durability, and transparency.

Each key top 3 is floatingly supported by a raised pedestal portion 12*c*, with its bottom surface being floated from the elastic member 14. The pedestal portion 12*c* in the form of an adhesive is applied not over the entire surface of the thin-walled floating portion 17 but is applied partially within the surface area thereof to cure. By thus setting a curing region 12*d* (see FIG. 1) of the pedestal portion 12*c* smaller in surface area than the thin-walled floating portion 17, the floating portion 17 can undergo elastic deformation in the region outside the curing region 12*b*, thus enabling depression displacement of the key tops 3. Therefore, there is no need to form, on the upper surface of the elastic member 14, protrusions for fixing the key tops 3 thereon. The absence of such protrusions enables reductions in the thickness and weight of the elastic member 14. The thickness of the key sheet 11 can be thus reduced.

The key sheet 11 according to the first embodiment can be manufactured by firmly attaching the key tops 3 to the above-described base sheet 12 with the adhesive that serves as the pedestal portion 12*c*.

The key sheet 11 obtained as described above has the elastic member 14 as its base, and the grid-like reinforcing member 13 having vertical and horizontal frames and embedded in the surface of the elastic member 14 made of hard resin. This construction makes the base sheet 12 free from distortion. Therefore, even when the key sheet 11 is erected or laid down to bear the weight of the key tops 3 on the reinforcing member 13, overall distortion of the key sheet 11 is restrained due to the rigidity of the reinforcing member 13. Thus, it is possible to eliminate such troubles as an operational failure due to positional deviation between the pushers 15 and contact switches 1*e* of a circuit board 1*d*, a deterioration in operation feel due to a difference in depression stroke among the key tops 3, a deterioration in the artistic design properties of the mobile phone 1, slipping of one of adjacent key tops 3 under the other, and dislodging of the elastic member 14 from the reinforcing member 13. Further, in the case of the illumination type key sheet 11, the key sheet 11 having superior artistic design properties can be obtained by forming the reinforcing member 13 from a high-transparency material so as to allow the metallic color of the metal layer 19 to show through the gaps between the key tops 3 during the non light-emission period while involving no leakage of light upon light emission.

SECOND EMBODIMENT

Figure 5:
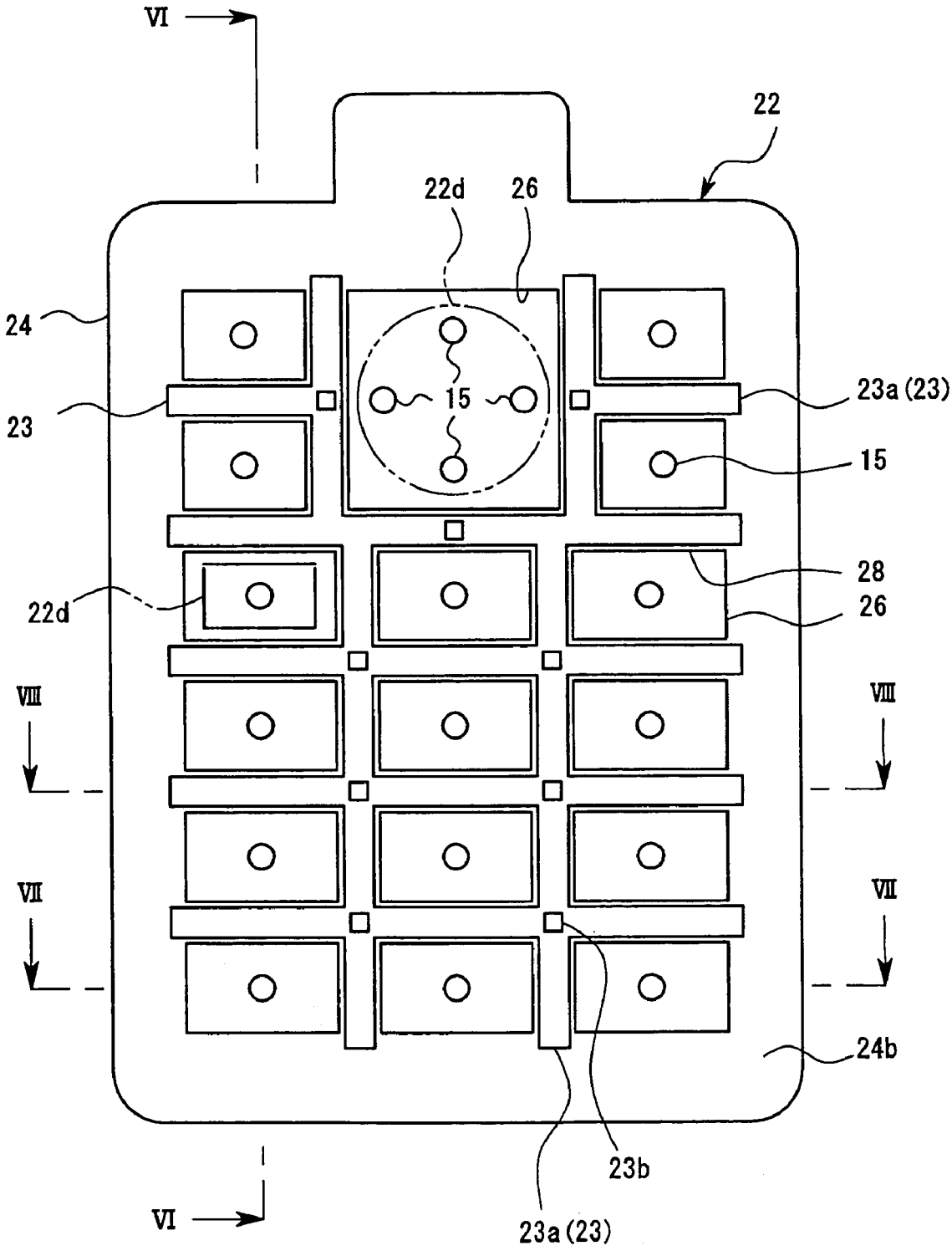
FIG. 5 is an outward view of a bottom surface of a key sheet according to a second embodiment of the present invention.
Figure 6:
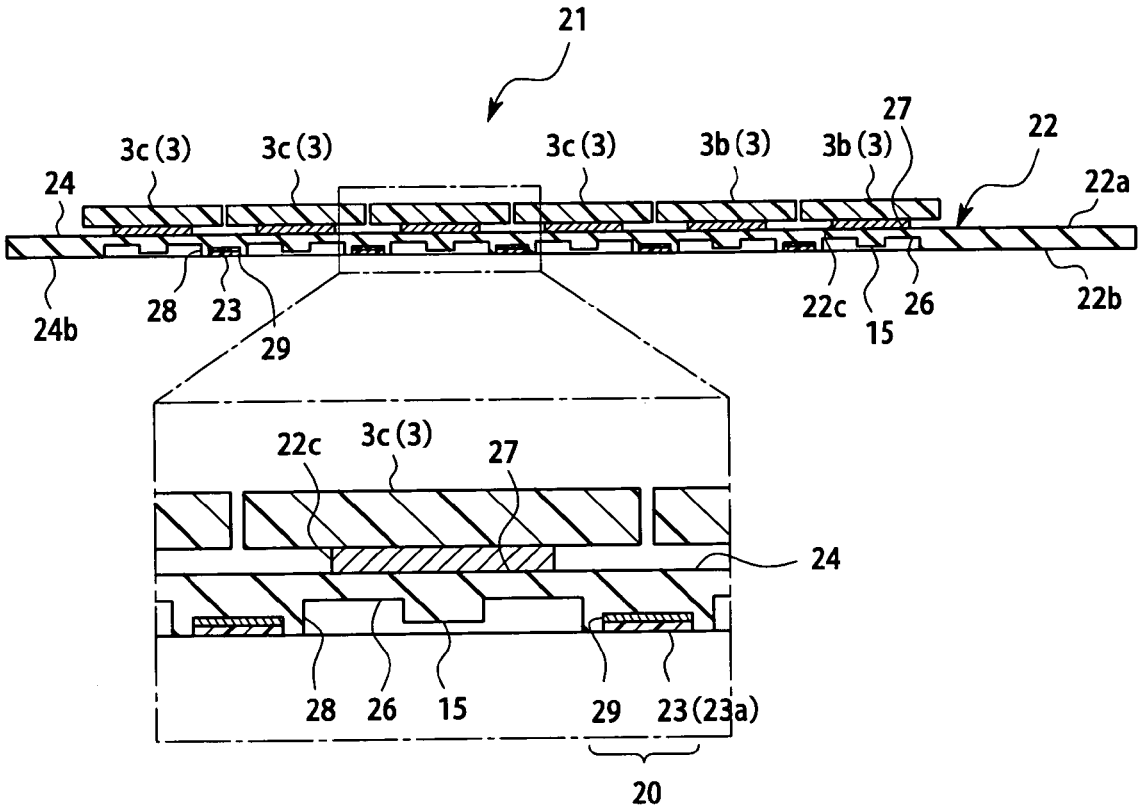
FIG. 6 is a sectional view of the key sheet taken along the line VI—VI of FIG. 5.
Figure 7:
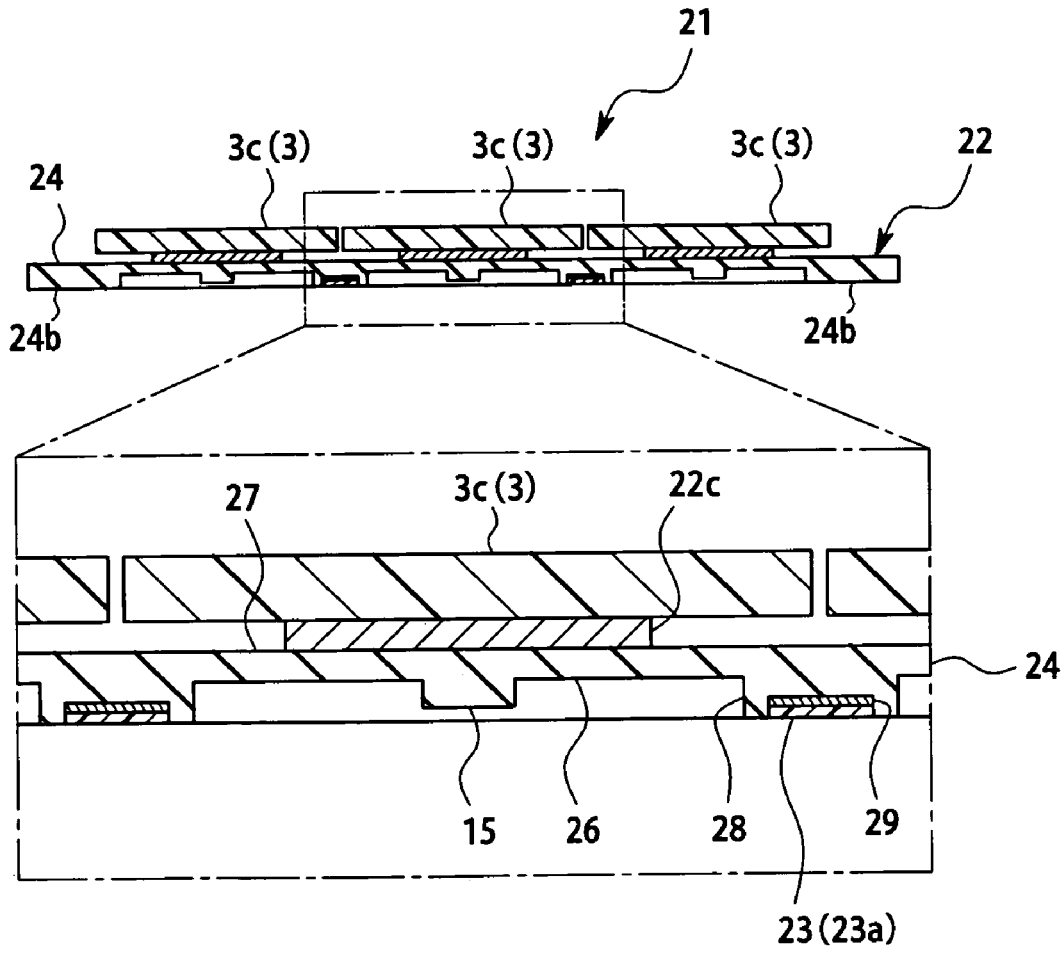
FIG. 7 is a sectional view of the key sheet taken along the line VII—VII of FIG. 5.

FIGS. 5 through 8 show a key sheet 21 according to a second embodiment of the present invention. The key sheet 21 represents a modification of the first embodiment. FIG. 5 is an outward view showing a bottom surface 22*b* of a base sheet 22. Referring to FIG. 5, this embodiment is different from the first embodiment in that a reinforcing member 23 formed of hard resin is provided on the bottom surface 22*b* side of the base sheet 22. This embodiment is identical to the first embodiment 1 in that a metal layer 29 is formed at the boundary surface between an elastic member 24 being a rubber-like elastic body and the reinforcing member 23. In this embodiment as well, the reinforcing member 23 serves to enhance the overall rigidity of the key sheet 21.

Figure 8:
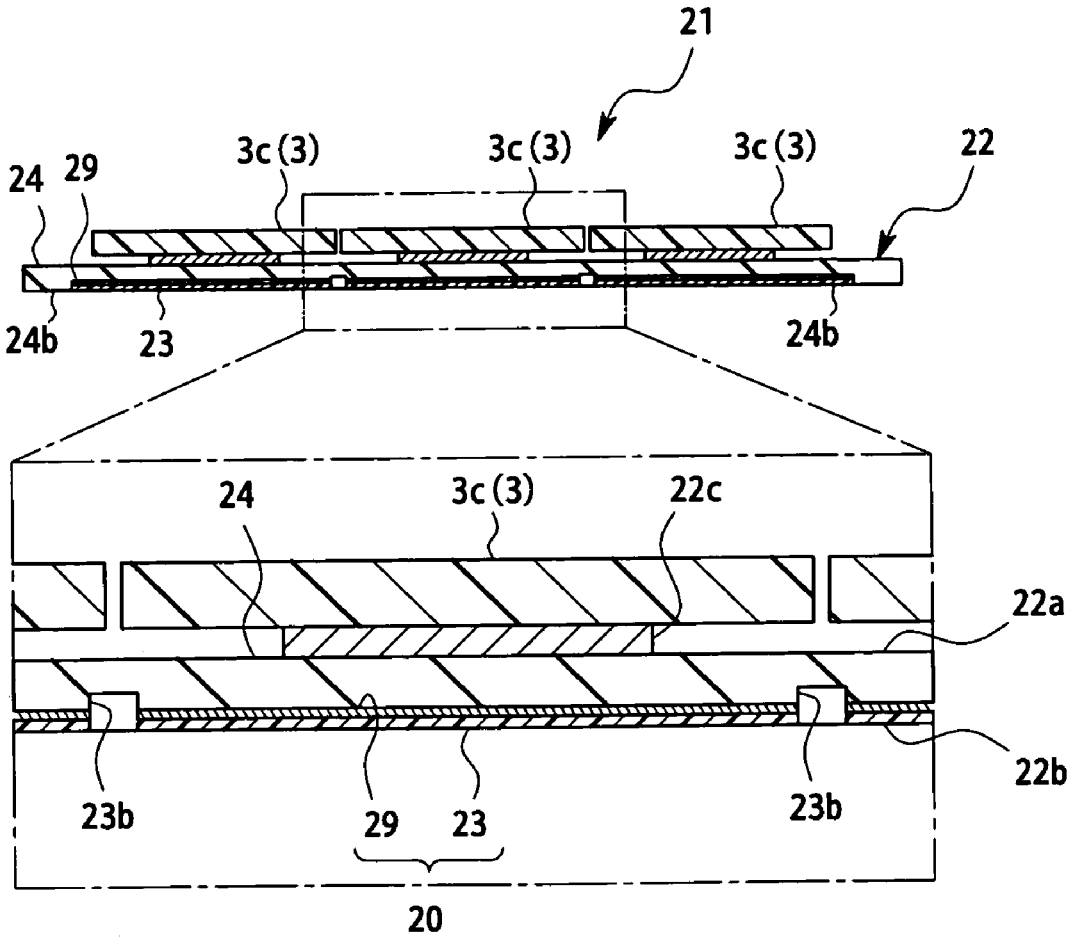
FIG. 8 is a sectional view of the key sheet taken along the line VIII—VIII of FIG. 5.

As shown in FIGS. 5 and 8, in order to provide the key sheet 12 of an illumination type, a cutaway portion 23*b* allowing entry of an internal light source is formed in the elastic member 24 at each of the locations where frame portions 23*a* of the reinforcing member 23 cross each other, that is, at the intersection positions between the vertical frames and the horizontal frames of the grid-like reinforcing member 23. In this embodiment, the metal layer 29 is provided in contact with the reinforcing member 23 arranged on the bottom surface 22*b* side of the base sheet 22, with the cutaway portion 23*b* penetrating through the reinforcing member 23 and the metal layer 29. Accordingly, light emitted from the internal light source placed in the cutaway portion 23*b* is illuminated also through the gaps between the key tops 3. Further, light entering the base sheet 22 and travelling toward the bottom surface 22*b* side of the base sheet 22 is readily reflected by the metal layer 29 and efficiently guided within the base sheet 22. The light then travels toward an upper surface 22*a* of the base sheet 22 for illumination. As a result, a brightly-lit key sheet 21 which permits illumination of light through the entire key sheet 21 can be obtained. Further, static electricity is removed from the key sheet 21 owing to the metal layer 29, thus preventing erroneous input or contamination resulting from such generation of static electricity.

The key sheet 21 of the second embodiment can be manufactured by using the same material and through the same method as those employed for the key sheet 11 of the first embodiment. It should be noted, however, that in the manufacture of the base sheet 21, the positioning between the reinforcing member 23 and the elastic member 24 can be advantageously effected with ease by fitting the cutaway portion 23*b* onto a corresponding protrusion formed within a mold conforming to the shape of the reinforcing member 23.

THIRD EMBODIMENT

Figure 9:
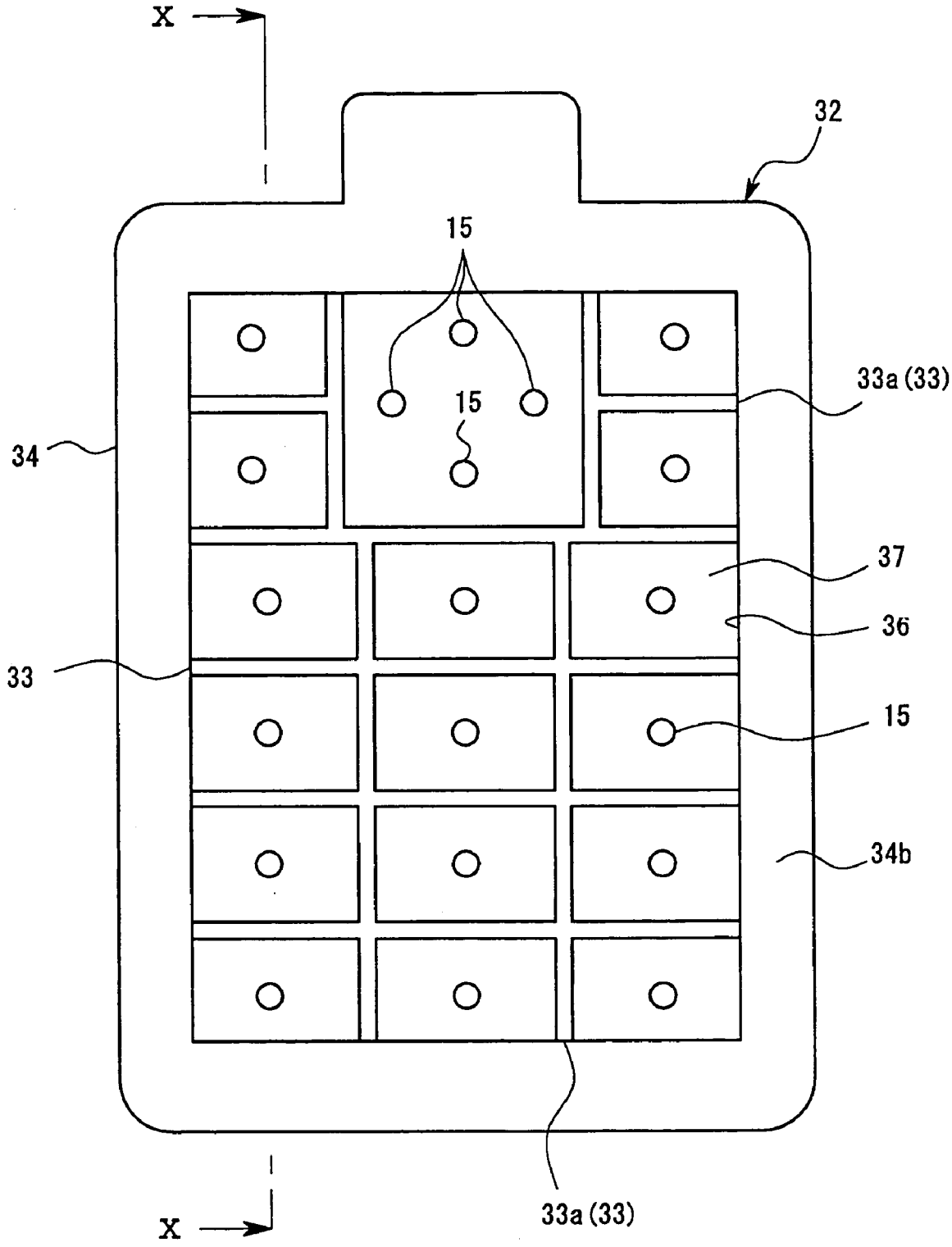
FIG. 9 is an outward view of the bottom surface of a key sheet according to a third embodiment of the present invention.
Figure 10:
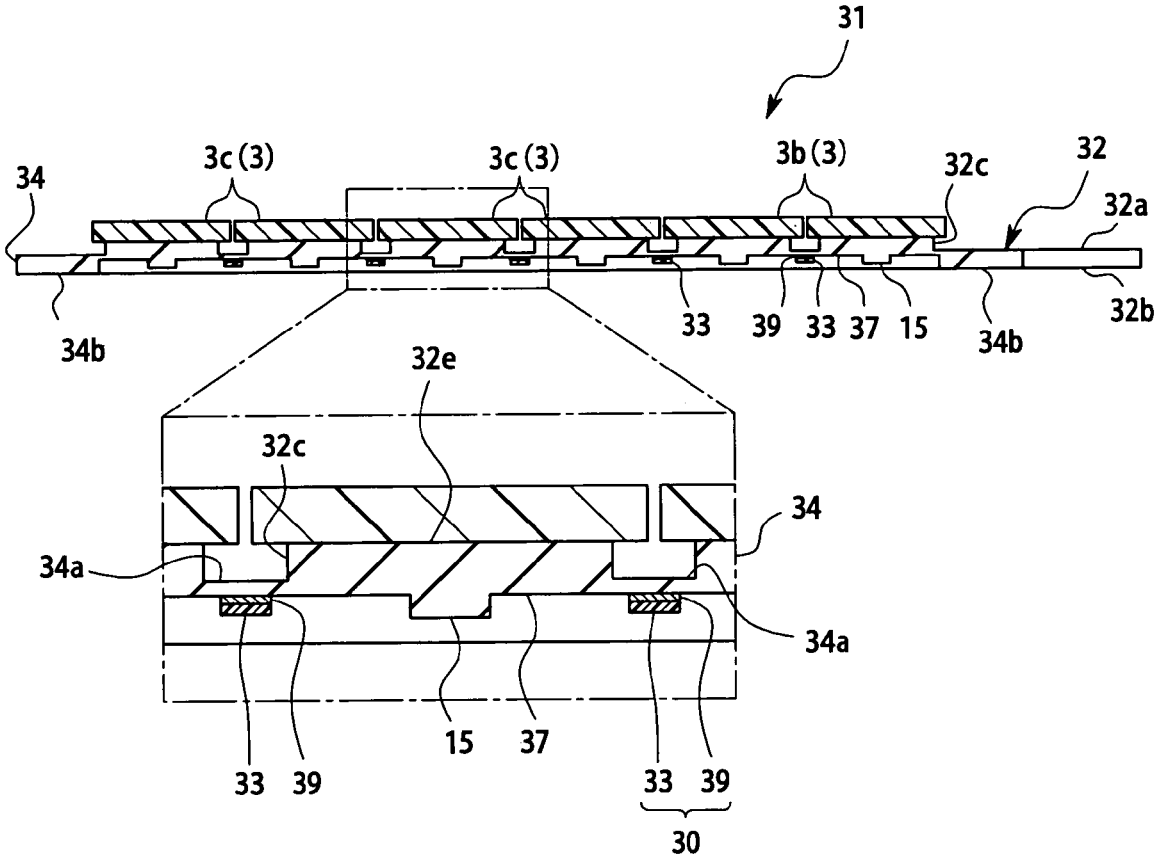
FIG. 10 is a sectional view of the key sheet taken along the line X—X of FIG. 9.

FIG. 9 and 10 show a key sheet 31 according to a third embodiment of the present invention. In the key sheet 31 of this embodiment, a light-reflective hard member 30, which includes a reinforcing member 33 made of hard resin and a metal layer 39, is firmly attached to the back surface of an elastic member 34 in such a manner that floating portions 37 formed on the elastic member 34 are partitioned to form a support portion 34*a*, thus supporting the key tops 3 so as to allow depression displacement of the key tops 3. Further, unlike in the first and second embodiments, protrusion-like pedestal portions 32*c* are formed on the upper surface of the elastic member 34 in advance. Accordingly, in this embodiment, the reinforcing member 33 serves to enhance the rigidity of the support portion 34*a*, which in turn enhances the overall rigidity of the base sheet 32, thereby making it possible to reliably restrain distortion of the key sheet 31. The material used for the key sheet 11 of the first embodiment may also be used for the key sheet 31 of this embodiment.

To manufacture the base sheet 32 as described above, the reinforcing member 33 is manufactured through die molding such as injection molding, and the light-reflective reinforcing member 30 with the metal layer 39 provided on the surface of the reinforcing member 33 is obtained by forming the metal layer 39 in the portion of the reinforcing member 33 which comes into contact with the support portion 34*a*, or by previously forming the metal layer 39 in the resin film from which the reinforcing member 33 is prepared, followed by trimming. Subsequently, in the case where a thermosetting elastomer is selected, the reinforcing member 33 having the metal layer 39 is transferred into the cavity of an injection molding die used for molding the thermosetting elastomer, and in the case where a thermoplastic elastomer is selected, the reinforcing member 33 having the metal layer 39 is transferred into the cavity of an injection molding die used for molding the thermoplastic elastomer. Thereafter, a rubber-like elastic body that forms the floating portion 37 and the support member 34*a* is poured into the mold for die molding. In this way, the support portion 34*a* of the elastic member 34 is molded integrally with the reinforcing member 33 through the intermediation of the metal layer 39, thus providing the base sheet 32. The key sheet 31 of this embodiment can be obtained by adhering the corresponding key tops 3 to the respective pedestal portions 32*c* with an adhesive 32*e*. Further, in another manufacturing method, the light-reflective reinforcing member 30 including the metal layer 39 and the reinforcing member 33 made of hard resin may be adhered to the back surface of the elastic member 34 using an adhesive.

FOURTH EMBODIMENT

Figure 11:
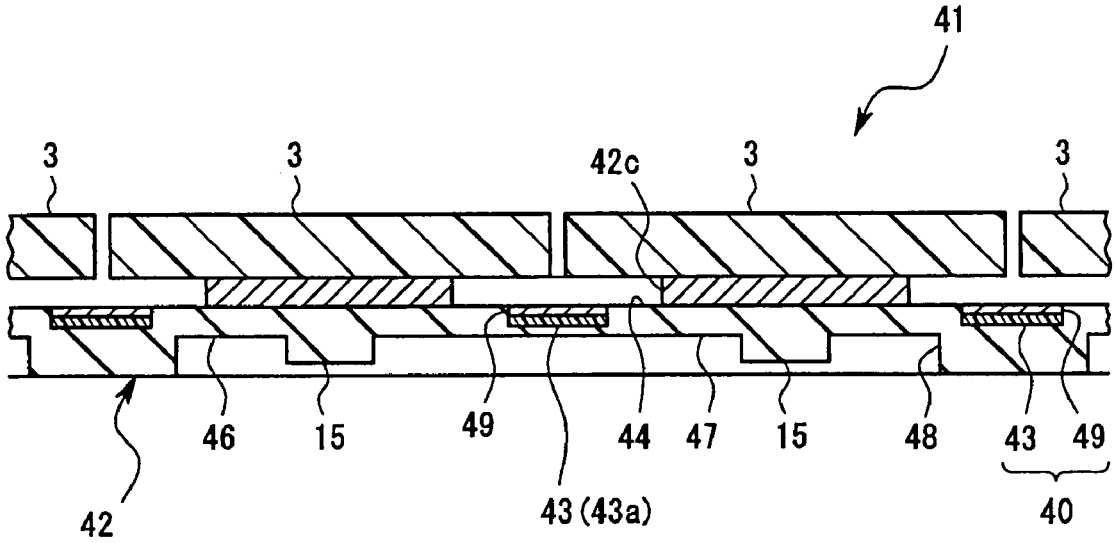
FIG. 11 is an enlarged main-portion sectional view of a key sheet according to a fourth embodiment of the present invention.

FIG. 11 shows a key sheet 41 according to a fourth embodiment of the present invention. While in both the first and second embodiments the reinforcing member 13, 23 is provided in the thick-walled portion 18, 28, it is also possible, like the key sheet 41 shown in FIG. 11, to provide a reinforcing member 43 without forming a thick-walled portion between the adjacent pushers 15. The key sheet 41 of this embodiment, too, can be manufactured by using the same material and through the same method as those employed for the key sheet 11 of the first embodiment.

FIFTH EMBODIMENT

Figure 12:
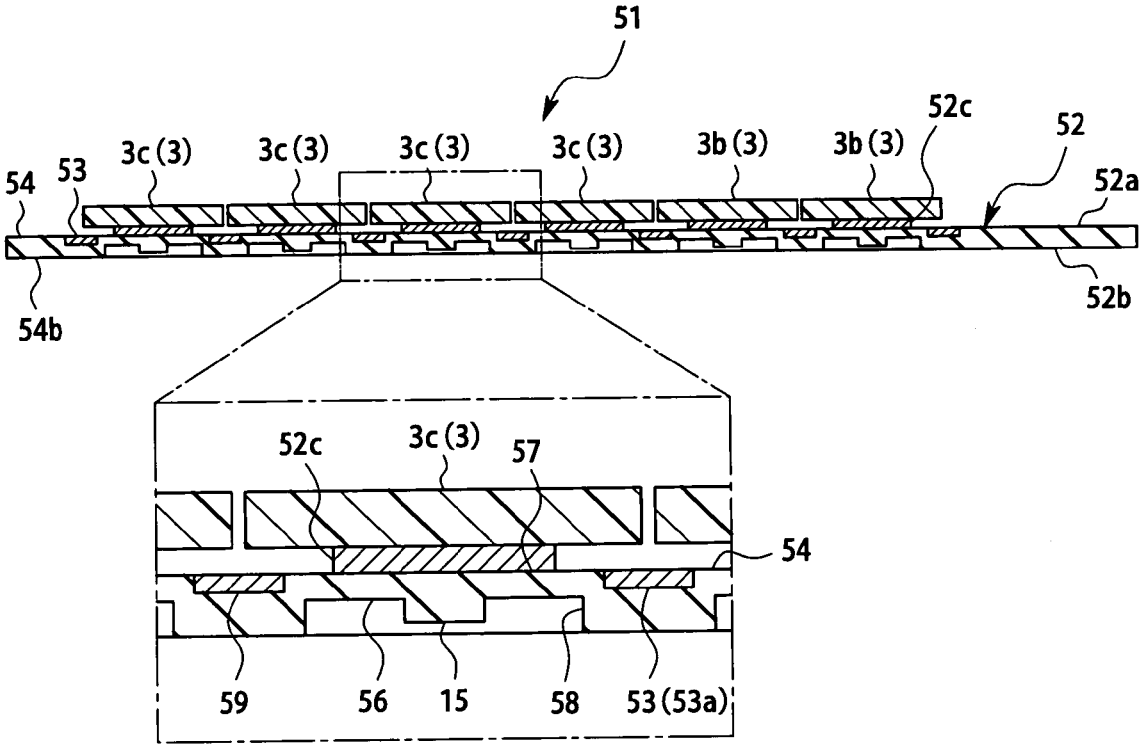
FIG. 12 is a sectional view, similar to FIG. 2, of a key sheet according to a fifth embodiment of the present invention.
Figure 13:
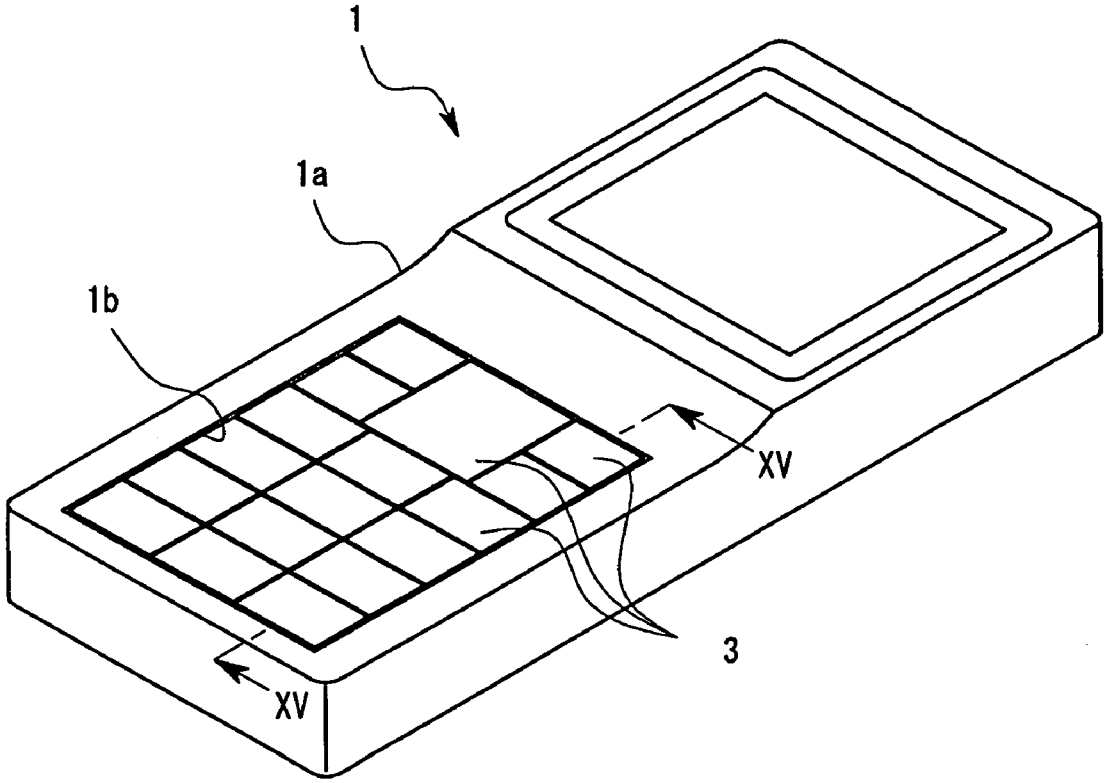
Fig.13 Prior Art
FIG. 13 is an outward perspective view of a conventional mobile phone.
Figure 14:
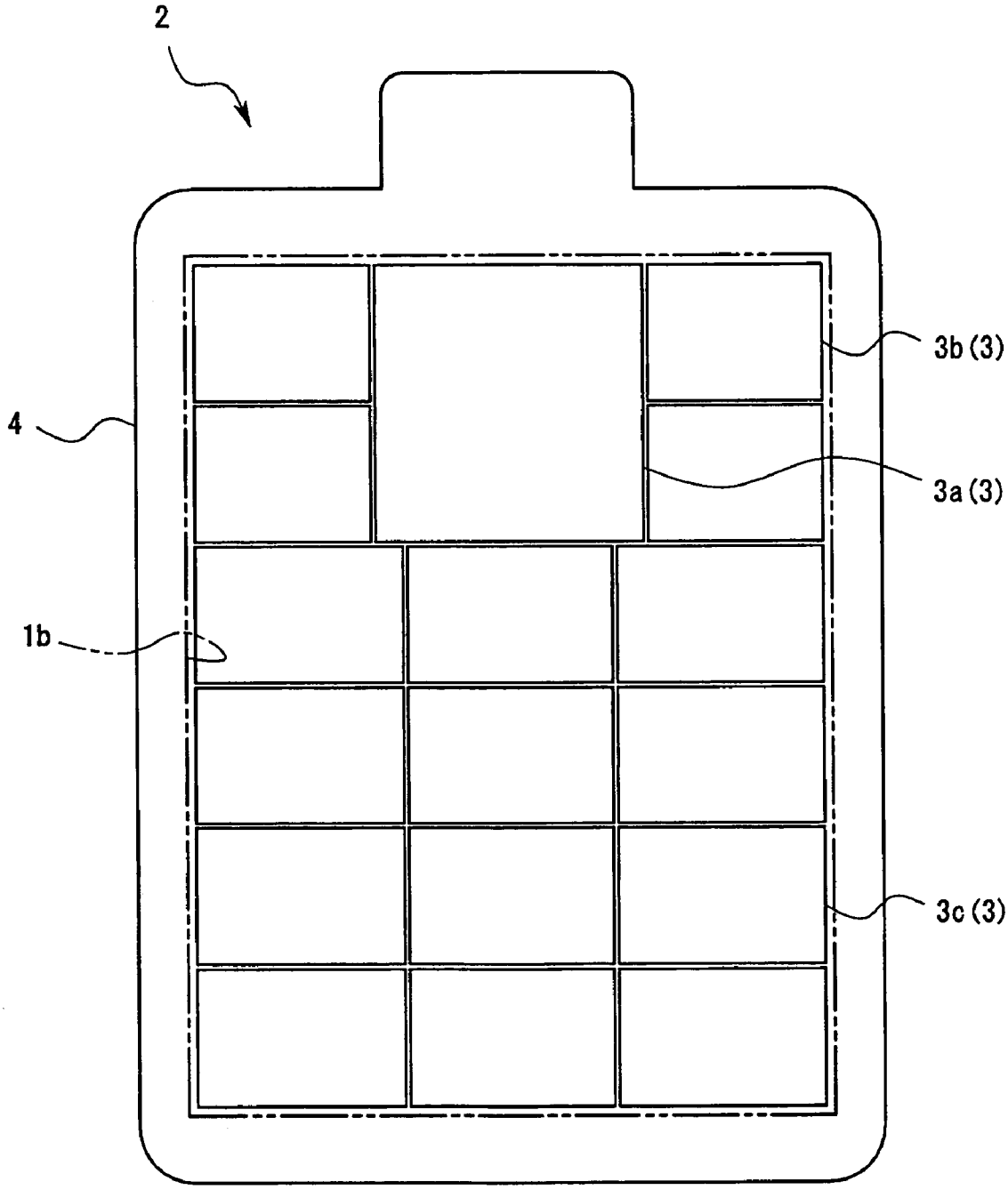
Fig.14 Prior Art
FIG. 14 is an outward view of the upper surface of a conventional key sheet as attached to the mobile phone shown in FIG. 13.
Figure 15:
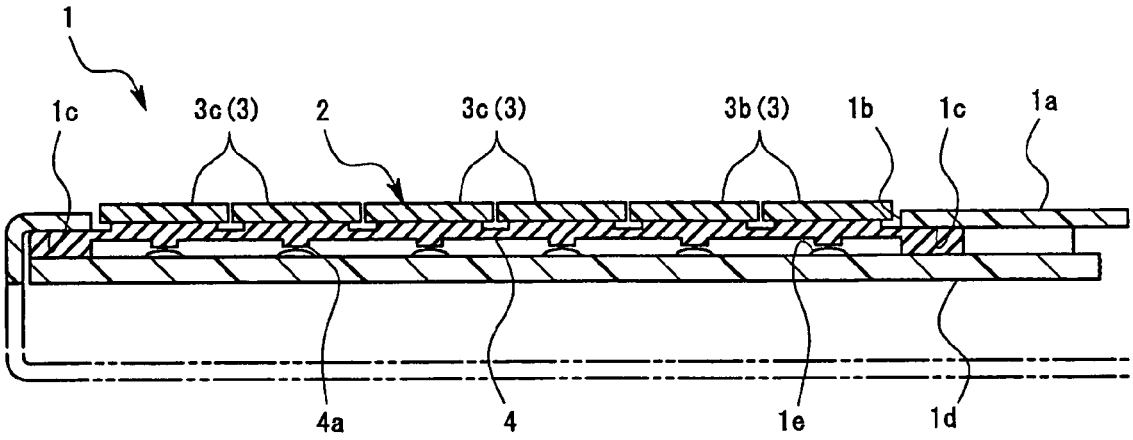
Fig.15 Prior Art
FIG. 15 is a schematic sectional view of the conventional mobile phone taken along the like XV—XV of FIG. 13.

FIG. 12 shows a key sheet 51 according to a fifth embodiment of the present invention. In the first embodiment, the metal layer 19 is provided at the boundary between the reinforcing member 13 made of hard resin and the elastic member 14 having a rubber-like elastic body, and the light-reflective reinforcing member 10 is formed by the reinforcing member 13 made of hard resin and the metal layer 19. In this embodiment, however, are inforcing member 53 itself is made of metal, thus forming the light-reflective reinforcing member 50 having no metal layer. From the viewpoint of restraining distortion of the key sheet 51, a high-rigidity material is preferably used for the reinforcing member 53 made of metal. Examples of the material that can be used for the reinforcing member 53 include stainless steel, aluminum, chrome, gold, silver, copper, nickel, and tin. Of those, particularly preferred are stainless steel, aluminum, gold, copper, and the like because they can be readily worked into a thin plate.

The thickness of the reinforcing member 53 made of metal is preferably within a range of 50 μm to 2,000 μm. This is due to the following reasons. That is, a thickness less than 50 μm provides only low rigidity, making it difficult to restrain distortion of the key sheet. Because there is a limitation to the thickness of a base sheet 54 as a whole, when the reinforcing member 53 has a thickness exceeding 2,000 μm, it only follows that the thickness of the elastic member 54 must be reduced relative to the reinforcing member 53; the elastic member 54 thus becomes too thin, making it impossible to efficiently guide light emitted from a light source.

MODIFICATIONS OF EMBODIMENTS

Modifications of the respective embodiments are described below. A construction with the reinforcing member 53 made of metal may be achieved, in addition to the arrangement as described in the fifth embodiment, by providing a reinforcing member made of metal in place of the reinforcing member 23, 33, 43 and the metal layer 29, 39, 49 in the second through fourth embodiments.

In each of the embodiments described above, a thermoplastic resin, a thermosetting resin, or a rubber-like elastic body such as silicone rubber or a thermoplastic elastomer can be used as the material of the key tops 3. Further, the base sheets 12, 22, 32, 42, and 52 have high rigidity, so that it is also possible to use a metallic material having a large weight. Further, a display portion for indicating characters, numbers, symbols, and the like with ink, plating, or the like may be formed on each key top 3. Further, the key tops 3 may be constructed as illumination type key tops with cut-out characters or with characters. Furthermore, the three-dimensional configuration of the key tops 3 may be changed from the one exemplified herein.

While in the above embodiments the floating portion 17, 27, 37, 47, 57 has a rectangular shape in plan view, it may also have a circular or elliptical shape, or any other such polygonal shape. Further, the overall configuration of the base sheet 12, 22, 32, 42, 52 may be one such as one obtained by combining the configurations of respective components described in the above embodiments. For example, the elastic member of a configuration with the pedestal portion provided on its upper surface, which is described in the third embodiment, may be used in the first embodiment. Further, the overall configuration of the base sheet 12 may be changed from those of the above embodiments.

Further, while the foregoing description is directed to the example of the reinforcing member 13, 23, 33, 43, 53 having a single molding conforming to the configuration of the frame portions 13*a*, 23*a*, 33*a*, 43*a*, 53*a* of the reinforcing member 13, 23, 33, 43, 53, the reinforcing member may be divided into a plurality of moldings. It should be noted that the each of the moldings thus divided is preferably continuous to at least an outer edge portion 14*b*, 24*b*, 34*b*, 44*b*, 54*b* of the base sheet. This is because when there is a reinforcing member that is cut away from the outer edge portion 14*b*, 24*b*, 34*b*, 44*b*, 54*b* and is present only in the central portion of the base sheet 12, 22, 32, 42, 52, it is difficult to support such a reinforcing member.

The location where the reinforcing member 13, 23, 33, 43, 53 is to be formed in the base sheet 12, 22, 32, 42, 52 can be changed as appropriate according to the layout of the key tops 3. Briefly speaking, the reinforcing member is preferably provided for reinforcement where there are at least two key tops that are adjacent to each other at a narrow spacing. Therefore, the reinforcing member is preferably provided between at least two adjacent floating portions 17, 27, 37, 47, 57 to which the key tops 3 are firmly attached.

While the key sheet 11, 21, 31, 41, 51 to be used in the mobile phone 1 has been exemplified in the above embodiments, the key sheet may also be used in other apparatuses such as a PDA and a remote controller.

EXAMPLES

Now, the present invention is described by way of examples. However, the present invention is not to be limited to the examples below.

Example 1

Example 1 of the present invention relates to the key sheet (11) described in the first embodiment, and has the construction as shown in FIGS. 1 through 4. The key sheet (11) was manufactured by using a black polyethyleneterephthalate film of 0.1 mm in thickness as the reinforcing member (13), a silicone rubber as the elastic member (14), an aluminum vapor-deposited layer having a visible light transmittance of 1% and a thickness of 80 mm as the metal layer (19), a polycarbonate resin as the key top (3), and an ultraviolet curing adhesive for adhesion between the key top (3) and the base sheet (12). The key sheet (11) thus obtained involved no overall distortion and was resistant to the generation of static elasticity. Further, when implemented as an illumination type key sheet, the key sheet (11) obtained involved no leakage of light through the gaps between the key tops (3) while permitting uniform illumination of light through the key tops (3).

Example 2

Example 2 of the present invention relates to the key sheet (21) described in the second embodiment, and has the construction as shown in FIGS. 5 through 8. The key sheet was manufactured by using a colorless polycarbonate resin film of 0.1 mm in thickness as the reinforcing member (23), an urethane-based thermoplastic elastomer as the elastic member (24), a silver vapor-deposited layer of 10 mm in thickness as the metal layer (29), a polycarbonate resin as the key top (3), and an instant adhesive for adhesion between the key top (3) and the base sheet (22), and by providing a resin layer formed of colorless, transparent urethane-based paint between the reinforcing member (23) and the metal layer (29). The key sheet thus obtained involved no overall distortion and was resistant to the generation of static elasticity. Further, when implemented as an illumination type key sheet, the key sheet (21) obtained was a brightly-lit key sheet that permits uniform illumination of light through the entire surface of the key sheet (21).

Example 3

Example 3 of the present invention relates to the key sheet (11) described in the first embodiment, and has the construction as shown in FIGS. 1 through 4. FIG. 12 shows the key sheet (51) according to Example 3. The key sheet (51) was manufactured by using a stainless steel sheet of 0.1 mm in thickness as the reinforcing member (53), a silicone rubber as the elastic member (54), a polycarbonate resin as the key top (3), and an ultraviolet curing adhesive for adhesion between the key top (3) and the base sheet (52). The key sheet (51) thus obtained involved no overall distortion and was resistant to the generation of static elasticity. Further, when implemented as an illumination type key sheet, the key sheet (51) obtained involved no leakage of light through the gaps between the key tops (3) while permitting uniform illumination of light through the key tops (3).

What is claimed is:

1. A key sheet comprising a base sheet, and a plurality of key tops arranged on the base sheet and exposed through an operation opening which is formed in a casing of an apparatus without a partition frame, wherein the base sheet comprises an elastic member formed of a rubber-like elastic body and having a plurality of floating portions to which the key tops are firmly attached, and a light-reflective reinforcing member that supports the floating portions such that the floating portions are capable of depression displacement, and wherein at least one face of the light-reflective reinforcing member comprises a metal-containing face.

2. A key sheet according to claim 1, further comprising a reinforcing member formed of hard resin, and a metal layer provided on a surface of the reinforcing member, wherein the light-reflective reinforcing member includes a laminate of the reinforcing member and the metal layer.

3. A key sheet according to claim 2, wherein the metal layer has a thickness within a range of 10 nm to 80 nm.

4. A key sheet according to claim 2, wherein the key sheet includes an illumination type key sheet in which the key tops are illuminated by light emitted from an illumination light source arranged on a back surface of the base sheet.

5. A key sheet according to claim 2, further comprising a cutaway portion allowing entry of the illumination light source, the cutaway portion being formed in the elastic member at each of intersection positions between vertical frames and horizontal frames of the reinforcing member having a grid-like configuration.

6. A key sheet according to claim 2, wherein the light-reflective reinforcing member is provided to one face of the elastic member situated on a key top side.

7. A key sheet according to claim 2, further comprising a thick-walled portion formed in the elastic member, wherein the light-reflective reinforcing member is provided to an upper face of the thick-walled portion.

8. A key sheet according to claim 2, wherein the light-reflective reinforcing member is provided to one face of the elastic member situated on a side opposite to the key tops.

9. A key sheet according to claim 2, further comprising a thick-walled portion formed in the elastic member, wherein the light-reflective reinforcing member is provided in a bottom face of the thick-walled portion.

10. A key sheet according to claim 1, wherein the light-reflective reinforcing member comprises a reinforcing member made of metal.

11. A key sheet according to claim 10, wherein the reinforcing member made of metal has a thickness within a range of 50 μm to 2,000 μm.

12. A key sheet according to claim 10, wherein the key sheet includes an illumination type key sheet in which the key tops are illuminated by light emitted from an illumination light source arranged on a back surface of the base sheet.

13. A key sheet according to claim 10, further comprising a cutaway portion allowing entry of the illumination light source, the cutaway portion being formed in the elastic member at each of intersection positions between vertical frames and horizontal frames of the reinforcing member having a grid-like configuration.

14. A key sheet according to claim 10, wherein the light-reflective reinforcing member is provided to one face of the elastic member situated on a key top side.

15. A key sheet according to claim 10, further comprising a thick-walled portion formed in the elastic member, wherein the light-reflective reinforcing member is provided to an upper face of the thick-walled portion.

16. A key sheet according to claim 10, wherein the light-reflective reinforcing member is provided to one face of the elastic member situated on a side opposite to the key tops.

17. A key sheet according to claim 10, further comprising a thick-walled portion formed in the elastic member, wherein the light-reflective reinforcing member is provided in a bottom face of the thick-walled portion.

* * * * *